US005798676A

United States Patent [19]

Jachowski

[11] Patent Number: 5,798,676

[45] Date of Patent: Aug. 25, 1998

[54] DUAL-MODE DIELECTRIC RESONATOR BANDSTOP FILTER

[75] Inventor: Douglas R. Jachowski, Maui, Hi.

[73] Assignee: Allen Telecom Inc., Solon, Ohio

[21] Appl. No.: 657,405

[22] Filed: Jun. 3, 1996

[51] Int. Cl.[6] ..... H01P 1/20; H01P 7/10; H01P 5/107; H01P 1/207

[52] U.S. Cl. ..... 333/202; 333/219.1; 333/230; 333/231; 333/208; 333/209; 333/229

[58] Field of Search ..... 333/202, 208, 333/209, 212, 227, 219.1, 229–232, 234, 235

[56] References Cited

U.S. PATENT DOCUMENTS

| | | | |
|---|---|---|---|
| 4,652,843 | 3/1987 | Tang et al. | 333/212 |
| 4,862,122 | 8/1989 | Blair, Jr. et al. | 333/212 X |
| 5,065,119 | 11/1991 | Jachowski | 333/202 |
| 5,191,304 | 3/1993 | Jachowski | 333/202 |
| 5,373,270 | 12/1994 | Blair et al. | 333/202 |
| 5,484,764 | 1/1996 | Fiedluszko et al. | 333/99 S X |
| 5,576,674 | 11/1996 | Jachowshi | 333/219.1 X |
| 5,589,807 | 12/1996 | Tang | 333/212 |

*Primary Examiner*—Robert J. Pascal
*Assistant Examiner*—Barbara Summons
*Attorney, Agent, or Firm*—Laff, Whitesel, Conte & Saret, Ltd.

[57] ABSTRACT

An electromagnetic bandstop filter comprises a microwave circuit, at least one microwave resonator, coupling means that couples electromagnetic energy to and from the microwave resonator, and an impedance transformer coupled to, and in series with, the coupling means, wherein the transformer is coupled to the resonator only through the coupling means, and wherein the impedance transformer is shunt coupled to the microwave circuit. The impedance transformer comprises at least two series-connected transmission line sections of different impedances.

43 Claims, 5 Drawing Sheets

DUAL-MODE DIELECTRIC RESONATOR BANDSTOP FILTER

FIELD OF THE INVENTION

This invention relates generally to bandstop filters and in particular to bandstop filters incorporating multiple impedance transformations between their input and output ports and the coupling mechanisms to their resonators, and is more particularly directed toward realizations of such filters incorporating dual-mode dielectric resonators coupled to a planar transmission line.

BACKGROUND OF THE INVENTION

Communication and imaging systems of all kinds require filters for signal processing. Filters are typically used to selectively attenuate certain signal frequencies. Bandstop filters in particular act to strongly attenuate a certain band of frequencies while passing, with minimal attenuation, other frequencies adjacent to either side of this "stop" band. Any of a variety of technologies are used to physically realize these filters. The technology of choice depends on the application requirements and on the portion of the frequency spectrum which is of interest, such as audio, microwave, or optical.

There are several different types of bandstop filters. For instance, with the aid of a directional or non-reciprocal device, such as a circulator, any type of bandpass filter can be utilized to provide a bandstop response. Further, bandstop filters can be constructed directly as a set of absorptive resonant circuits connected to a common transmission line and to each other.

A microwave bandstop filter to which the present invention is related is disclosed in U.S. Pat. No. 5,065,119. This microwave bandstop filter includes a length of transmission line to which multiple one-port, reflective, single-mode resonators are coupled—either by direct contact, by probe, by loop, or by iris—at nominal spacings of an odd multiple of a quarter wavelength. The individual resonators are typically quarter-wavelength transmission line resonators, cavity resonators with air dielectric, or cavity resonators loaded with a low loss, high dielectric constant ceramic and which are conventionally called dielectric resonators.

Although the filter of U.S. Pat. No. 5,065,119 is a workable design, filter efficiency would be improved through improvements in filter performance—decreased passband loss, increased stop band attenuation, increased selectivity, etc.—and through reductions in filter size and cost.

For communication filters operating at microwave frequencies, it is well-known that the use of dielectric resonators allows for significant improvements in filter efficiency when compared with the use of air-dielectric cavity resonators. Although it is problematic to directly couple strongly enough to a dielectric resonator for some applications, sufficient effective coupling has been attained by incorporating certain impedance transformations in the transmission line, again as illustrated in U.S. Pat. No. 5,065,119.

In addition, it is known that optimally chosen electrical lengths of transmission lines between successive resonance couplings to and along the common transmission line, such as spacings which exhibit so-called "complex conjugate symmetry," provide a means for further improving bandstop filter efficiency. It is well-known that such an approach, when combined with impedance transformations along the transmission line, can be applied to dielectric resonator bandstop filters to achieve even better performance.

Dual-mode resonators offer further improvements in filter efficiency over single-mode resonators, particularly with respect to filter size. Consequently, it would be desirable to use dual-mode resonators in bandstop filter applications. However, in bandstop filters, the use of dual-mode resonators—and, in particular, dual-mode dielectric resonators—presents at least three unique problems of practical significance which have not yet been adequately addressed in filters of the prior art.

These problems are (1) establishing strong enough coupling to the resonances to achieve the desired filter performance, (2) coupling to each of the two orthogonal resonances of each resonator in a convenient and inexpensive way, and (3) adequately isolating a resonator's two orthogonal resonances from each other.

For relatively selective bandstop filters with a relatively large amount of stopband attenuation, it can be difficult to achieve the required coupling between dual-mode resonances and the common transmission line with direct coupling to the resonances from loops or probes themselves. Since the effective coupling to a resonator is proportional to the effective impedance seen looking out from the coupling mechanism toward the source and the load, increasing this effective impedance provides a practical alternative to increasing the direct coupling from probes or loops. In the most conventional case (where the common transmission line impedance is chosen to be the same as the filter's source and load impedances, which are both typically 50 ohms) the ratio of the effective source impedance seen by the coupling mechanism to the impedance of the source is ½. If impedance transformers are incorporated into the transmission line, and the practical constraints relating to transmission line fabrication are accounted for (allowing for a maximum impedance between 100 and 200 ohms, for example) then this ratio, and the effective coupling, can be increased by a factor of between 2 and 4 for multiple resonator filters.

Although this technique has proven adequate for filters using single-mode dielectric resonators, it is even more difficult to achieve an adequate degree of loop or probe coupling to dual-mode dielectric resonators. Thus, some additional mechanism for further increasing effective coupling is needed to successfully apply dual-mode dielectric resonators to bandstop filters which utilize a common transmission line.

Other practical difficulties presented by using dual-mode resonators coupled to a common transmission line are where to locate, and how to orient, the coupling mechanisms, and how to route the transmission line between them. In dual-mode resonator bandstop filters of the prior art, the coupling mechanisms have been oriented orthogonally to each other in a common plane, and the transmission line has been waveguide or coaxial cable which was routed in three dimensions between two orthogonal sides of each resonator cavity.

These types of transmission lines are awkward to assemble, relatively expensive, and not very amenable to the incorporation of impedance transformations and the use of multiple impedances. A better location of the coupling mechanisms, a simpler transmission line construction and routing, and a transmission line technology more suited to the incorporation of impedance transformers and multiple impedances would all aid in making the use of dual-mode resonators in bandstop filters more economically attractive.

In addition, this type of bandstop filter relies on the absence of direct coupling between resonators to function properly. In filters based on single-mode resonators, this is typically not a problem, since the resonances can be physically isolated quite easily. However, the orthogonal modes of a dual-mode resonator are naturally in close proximity to each other, and asymmetries, irregularities, and other non-idealities in the shapes, positions, or compositions of the materials comprising the resonators may introduce coupling between the two orthogonal modes.

Although careful construction has reportedly led to adequate isolation between the orthogonal resonances in a dual-mode air cavity resonator, such performance does not appear to be practical in dual-mode dielectric resonator filters. Thus, a way must still be found to compensate for, or cancel, the unwanted coupling between the two orthogonal resonances which unavoidably occurs in practice. In dual-mode bandpass filters, it is common practice to use mode coupling mechanisms (i.e., screws), oriented 45 degrees from either of the orthogonal resonant mode axes, to create and adjust coupling between the mode resonances. A mode coupling screw has also been suggested for the implementation of an absorptive, coupled dual-mode bandstop filter. But, so far, no suggestions have appeared for practical means to provide mode decoupling in a dual-mode bandstop filter.

Finally, a key problem for any filter utilizing dielectric resonators is how to rigidly and inexpensively support the ceramic in the cavity while maintaining high resonator unloaded Q. Careful attention to the solution of this resonator support problem in single-mode $TE_{01}$ dielectric resonators has led to the common use of a relatively large axial hole (25%–35% of the outer diameter of the ceramic) through the cylindrical $TE_{01}$ ceramic, a single lower axial support, and the realization of unloaded Q's in the 20,000 to 30,000 range. The higher order $HEH_{11}$ dual-mode resonances have potentially much higher unloaded Q's than the lower order single-mode resonances. However, the different field distributions of the dual-mode teach away from incorporating an axial hole through the cylindrical ceramic in $HEH_{11}$ applications, and teach away from using an axial support. Consequently, the current practice is to use solid cylindrical ceramics for $HEH_{11}$ applications, forcing the use of lossier and more costly means of support for the ceramic within the cavity, which generally leads to an unloaded Q no better than that of single-mode resonators.

SUMMARY OF THE INVENTION

The problems outlined above are addressed, and the needs are satisfied, by the electromagnetic filter of the present invention, which comprises a microwave circuit, at least one microwave resonator, coupling means that couples electromagnetic energy to and from the microwave resonator, and an impedance transformer coupled to, and in series with, the coupling means, wherein the transformer is coupled to the resonator only through the coupling means, and wherein the impedance transformer is shunt coupled to the microwave circuit. The impedance transformer comprises at least two series-connected transmission line sections of different impedance. The coupling means is a coupling probe having two ends, with one of the ends open-circuited, and the other of the ends coupled to the impedance transformer.

The resonator is a dual-mode dielectric resonator, and the probe is coupled to a resonance of the dual-mode dielectric resonator. The impedance transformer has an operating frequency corresponding to an operating wavelength, and is comprised of a first transmission line having at least two sections of different impedance, a first section of the first transmission line having a length of an odd multiple of one-quarter wavelength and having a first impedance, and a second section of the first transmission line having a second impedance larger than the first impedance. One end of the second section is coupled to one end of the first section, and the other end of the second section is coupled to the coupling means.

The microwave circuit preferably comprises a second transmission line, the second transmission line having a third impedance larger than the first impedance. The transmission lines are planar transmission lines comprising at least two conductors and at least one dielectric at least partially separating two of the conductors. The planar transmission lines may be striplines.

The microwave circuit comprises a common transmission line of the microwave bandstop filter, the common transmission line having an input end and an output end, where the input and output ends function as signal input and output, respectively, of the filter.

In one form of the invention, a bandstop filter comprises a first transmission line with an input end and an output end, at least one resonator, and at least one coupling means for coupling electromagnetic energy between the first transmission line and a resonance of the resonator. The coupling means comprises a coupling element that is attached to an impedance transformer coupled to the resonance only through the coupling element, and the impedance transformer is coupled directly to the first transmission line. The coupling element may be a coupling probe.

The impedance transformer has an operating frequency corresponding to an operating wavelength, and is comprised of a second transmission line having at least two sections of different impedance, a first section of the second transmission line having a length of an odd multiple of one-quarter wavelength and having a first impedance, and a second section of the second transmission line having a second impedance larger than the first impedance. One end of the second section is coupled to one end of the first section, and the other end of the second section is coupled to the coupling means. The first transmission line has a third impedance larger than the first impedance.

In another form of the invention, a microwave bandstop filter with a predetermined stop band having a center frequency corresponding to an operating wavelength comprises a first transmission line with an input end and an output end, at least one microwave dual-mode resonator having a first resonance and a second resonance within the stop band, first coupling means for coupling microwave energy between the transmission line and the first resonance, and second coupling means for coupling microwave energy between the transmission line and the second resonance. The first and second coupling means each comprises a coupling mechanism coupled to a resonance and attached to a first impedance transformer that is coupled to the resonance only through the coupling mechanism, and the impedance transformer is coupled directly to the first transmission line.

The dual-mode resonator may be a dual-mode dielectric resonator. The coupling mechanism is a coupling probe having two ends, with one of the ends open circuited, and the other of the ends attached to the first impedance transformer.

The first impedance transformer has an operating frequency corresponding to the center frequency and the operating wavelength, the first impedance transformer comprising a second transmission line having at least two sections of different impedances, a first section of the second transmission line having a length of an odd multiple of one-quarter of the operating wavelength and having a first impedance, and a second section of the second transmission line having a second impedance larger than the first impedance. One end of the second section is coupled to one end of the first section, and the other end of the second section is coupled to the coupling probe, and the first transmission line has a third impedance larger than the first impedance.

The first and second transmission lines are planar transmission lines, comprising at least two conductors and at least one dielectric at least partially separating two of the conductors. The planar transmission lines may be striplines. The first transmission line incorporates a second impedance transformer in series with the input end and a third impedance transformer in series with the output end.

In yet another form, a microwave bandstop filter having a stop band with a predetermined center frequency comprises a microwave transmission line with an input end and an output end, and at least one microwave dual-mode resonator having a first resonance along a first axis and a second resonance along a second axis orthogonal to said first axis, wherein both of the resonances are within the stop band.

The filter includes a first coupling means for coupling microwave energy between the transmission line and the first resonance, a second coupling means for coupling microwave energy between the transmission line and the second resonance, and a mode decoupling means for substantially reducing coupling between resonances. The mode decoupling means comprises at least one of two orthogonal screws located at an odd multiple of 45 degrees with respect to the axes.

In one aspect of the invention, the microwave bandstop filter further includes first resonant mode frequency tuning means oriented in a common first vertical plane with the first coupling means, and second resonant mode frequency tuning means oriented in a common second vertical plane with the second coupling means. The second vertical plane is orthogonal to the first vertical plane. The filter also includes decoupling means for substantially reducing coupling between resonances.

The mode decoupling means comprises at least one of two mode decoupling screws having mutually orthogonal main axes, wherein each of the main axes is oriented an odd multiple of 45 degrees with respect to both first and second vertical planes.

In yet another form of the invention, a microwave filter has a transmission line with an input end and an output end, and at least one tunable dual-mode resonator. The filter comprises a conductive cavity, having at least a first planar surface, first tuning means for tuning the resonator to a first resonance at a first frequency along a first axis, and second tuning means for tuning the resonator to a second resonance at a second frequency along a second axis orthogonal to the first axis.

The filter further includes first coupling means for coupling microwave energy between the transmission line and the first resonance, and second coupling means for coupling microwave energy between the transmission line and the second resonance. The first and second coupling means each comprising a coupling mechanism coupled to the resonance and attached to a first impedance transformer that is coupled to the resonance only through the coupling mechanism. The first and second coupling means enter the resonator cavity through the first planar surface, and the first impedance transformer is coupled directly to the first transmission line.

The dual-mode resonator is a dual-mode dielectric resonator. The dual-mode dielectric resonator may be an $HEH_{11}$ dual-mode dielectric resonator, the cavity may include a ceramic component, and the cavity and the ceramic component may be circular-cylindrical in shape and share a common central axis.

The dual-mode resonator may include mode decoupling means for substantially reducing coupling between the resonances, where the mode decoupling means may comprise at least one of two orthogonal screws, oriented radially with respect to the central axis, and located at an odd multiple of 45 degrees with respect to the resonance axes. The transmission line incorporates a second impedance transformer in series with the input end and a third impedance transformer in series with the output end.

At least some of the resonances may be tuned to different frequencies, coupled to the transmission line in a predetermined sequence, and tuned in ascending order according to that sequence. The ceramic component of the dual-mode dielectric resonator is preferably circular-cylindrical in shape with an associated outer diameter, and includes an opening along its axis. The opening is no smaller in diameter than two percent of the outer diameter of the ceramic component, and no larger in diameter than 10 percent of the outer diameter of the ceramic component through which it extends.

In a further aspect of the invention, a filter includes at least one dual-mode dielectric resonator, wherein the resonator comprises a conductive cavity, with a ceramic component within the cavity. The ceramic component is circular-cylindrical in shape with an associated outer diameter and includes an opening along its central axis. The opening is no smaller in diameter than two percent of the outer diameter of said ceramic component, and no larger than 10 percent of the outer diameter of the ceramic component through which it extends.

The resonator further includes upper and lower support means, wherein a portion of the support means engages the opening in the ceramic. The support means maintains the ceramic from making direct contact with the cavity.

The resonator includes a first resonance at a first frequency along a first axis, and a second resonance at a second frequency along a second axis orthogonal to the first axis, as well as a first coupling means for coupling microwave energy between an external circuit and the first resonance, and a second coupling means for coupling microwave energy between an external circuit and the second resonance, and includes means for adjustably decoupling the resonances.

In still another aspect of the invention, a filter includes at least one dual-mode resonator, wherein the dual-mode resonator comprises a conductive cavity having at least a first planar surface, a first resonance within the cavity at a first frequency along a first axis, and a second resonance within the cavity at a second frequency along a second axis orthogonal to the first axis.

The dual-mode resonator further includes first coupling means for coupling microwave energy between an external circuit and the first resonance, and second coupling means for coupling microwave energy between an external circuit and the second resonance, wherein the first and second coupling means enter the resonator cavity through the first planar surface. The first and second coupling means are substantially perpendicular to the first planar surface. The dual-mode resonator may be a dual-mode dielectric resonator.

The filter may further include adjustable decoupling means for reducing the coupling between the resonances.

Preferably, the adjustable decoupling means are mode decoupling means comprising at least one of two orthogonal screws located at an odd multiple of 45 degrees with respect to the axes. The orthogonal screws are oriented radially with respect to a central axis of the resonator.

A first planar transmission line is coupled to the first resonator coupling means, and a second planar transmission line is coupled to the second resonator coupling means. The first planar transmission line is coupled to a first location along a third planar transmission line, and the second planar transmission line is coupled to a second location along the third planar transmission line.

Further objects, features, and advantages of the present invention will become apparent from the following description and drawings.

DETAILED DESCRIPTION OF THE INVENTION

In accordance with the present invention, a dual-mode dielectric resonator bandstop filter is described that provides distinct advantages when compared to those of the prior art. The invention can best be understood with reference to the accompanying drawing figures.

Figure 1:
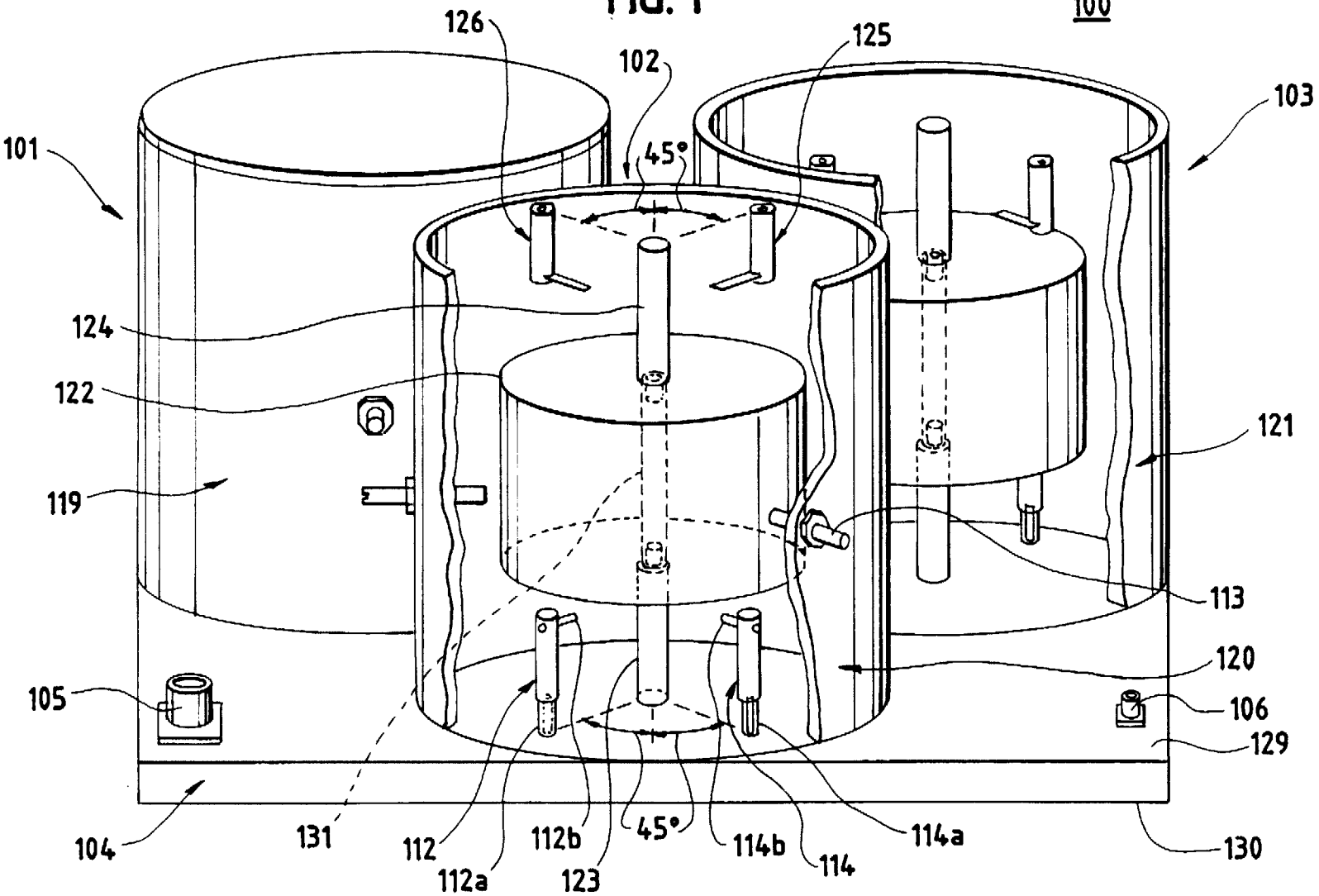
FIG. 1 is a top, front perspective view of a six resonance, dual-mode dielectric resonator microwave bandstop filter in accordance with the present invention.
Figure 2:
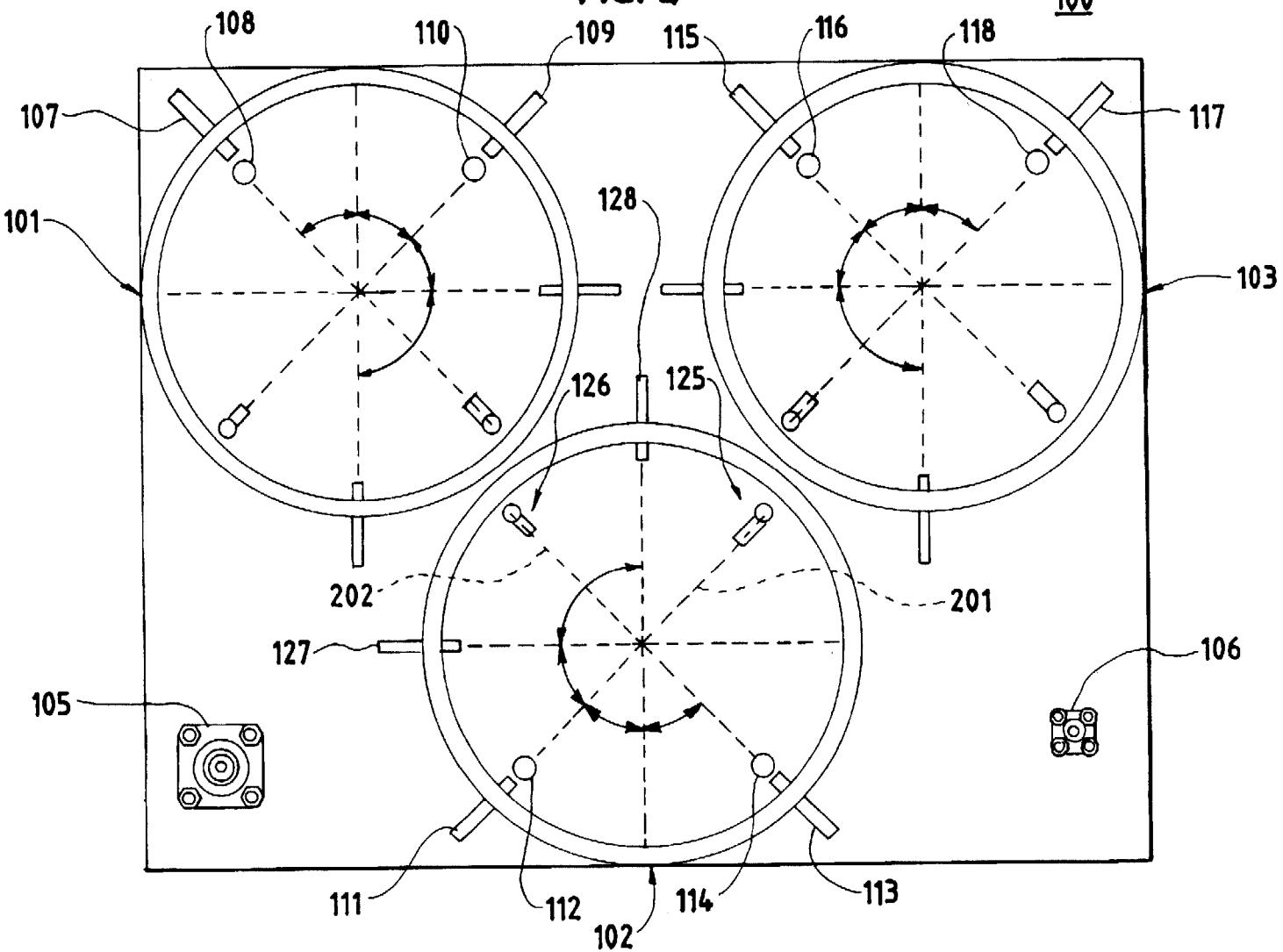
FIG. 2 is a top view of the filter of FIG. 1.

FIGS. 1 and 2 illustrate an $HEH_1L$ dual-mode dielectric resonator bandstop filter, generally depicted by the numeral 100, designed to attenuate the power of input frequencies in the 845.25 MHz to 846.25 MHz range by at least 20 dB, to pass signals in the 835 MHz to 845 MHz and 846.5 MHz to 849 MHz ranges with less than 1 dB attenuation and more than 14 dB return loss, and to fit within a 5.0"×9.0"×11.5" volume. The filter 100 depicted in the figure is relatively insensitivity to vibration and mechanical and thermal shock, and has an overall temperature coefficient of frequency of less than 1 ppm/° C. (part-per-million per degree Celsius) from −30° C. to +65° C. The filter 100 is comprised of three substantially identical $HEH_1L$ dual-mode dielectric resonators 101–103, a stripline transmission line assembly 104, a 50 ohm female N-type connector 105, and a 50 ohm female SMA connector 106. Each of the resonators may be considered a microwave resonator because of the relatively high frequency of operation.

The first resonator 101 exhibits a first resonance $f_1$—tuned by frequency adjustment screw 107 (FIG. 2) and coupled to by probe 108—and a second resonance $f_2$—tuned by frequency adjustment screw 109 and coupled to by probe 110. The second resonator 102 exhibits a first resonance $f_3$—tuned by frequency adjustment screw 111 and coupled to by probe 112—and a second resonance $f_4$—tuned by frequency adjustment screw 113 and coupled to by probe 114. The third resonator 103 exhibits a first resonance $f_5$—tuned by frequency adjustment screw 115 and coupled to by probe 116 and a second resonance $f_6$—tuned by frequency adjustment screw 117 and coupled to by probe 118. The resonance frequencies $f_1$ through $f_6$ all occur within the stop band of the filter 100 and are tuned in an ascending manner, such that $f_1<f_2<f_3<f_4<f_5<f_6$.

Each of the substantially identical resonators 101–103 is comprised of a conductive, circular-cylindrically shaped cavity 119–121 (FIG. 1), a circular-cylindrically shaped ceramic 122, lower 123 and upper 124 support rods for supporting the ceramics 122 within the cavities 119–121, first 112 and second 114 electromagnetic coupling probes, corresponding first 111 and second 113 resonant mode frequency tuning screws, first 127 and second 128 resonant mode decoupling screws, and first 125 and second 126 temperature compensating elements.

FIG. 2 provides a more complete illustration of the orientation of the mode decoupling screws 127, 128 and mode frequency tuning screws 111, 113 relative to each other and to the resonator coupling probes 112, 114. In each of the dual-mode resonators 101–103, the coupling probe 112, the frequency tuning screw 111, and the temperature compensating element 125 are all oriented in approximately the same first vertical plane 201 through the central axis of the ceramic 122, and are all associated with a first resonance of the resonator, while the coupling probe 114, the frequency tuning screw 113, and the temperature compensating element 126 are all oriented in approximately the same second vertical plane 202 through the central axis of the ceramic 122—which is orthogonal to the first such vertical plane 201—and are all associated with a second resonance, orthogonal to the first resonance. The mode decoupling screws 127 and 128 have main axes which are orthogonal to each other and which are oriented an odd multiple of 45 degrees from frequency tuning screws 111, 113.

Figure 3:
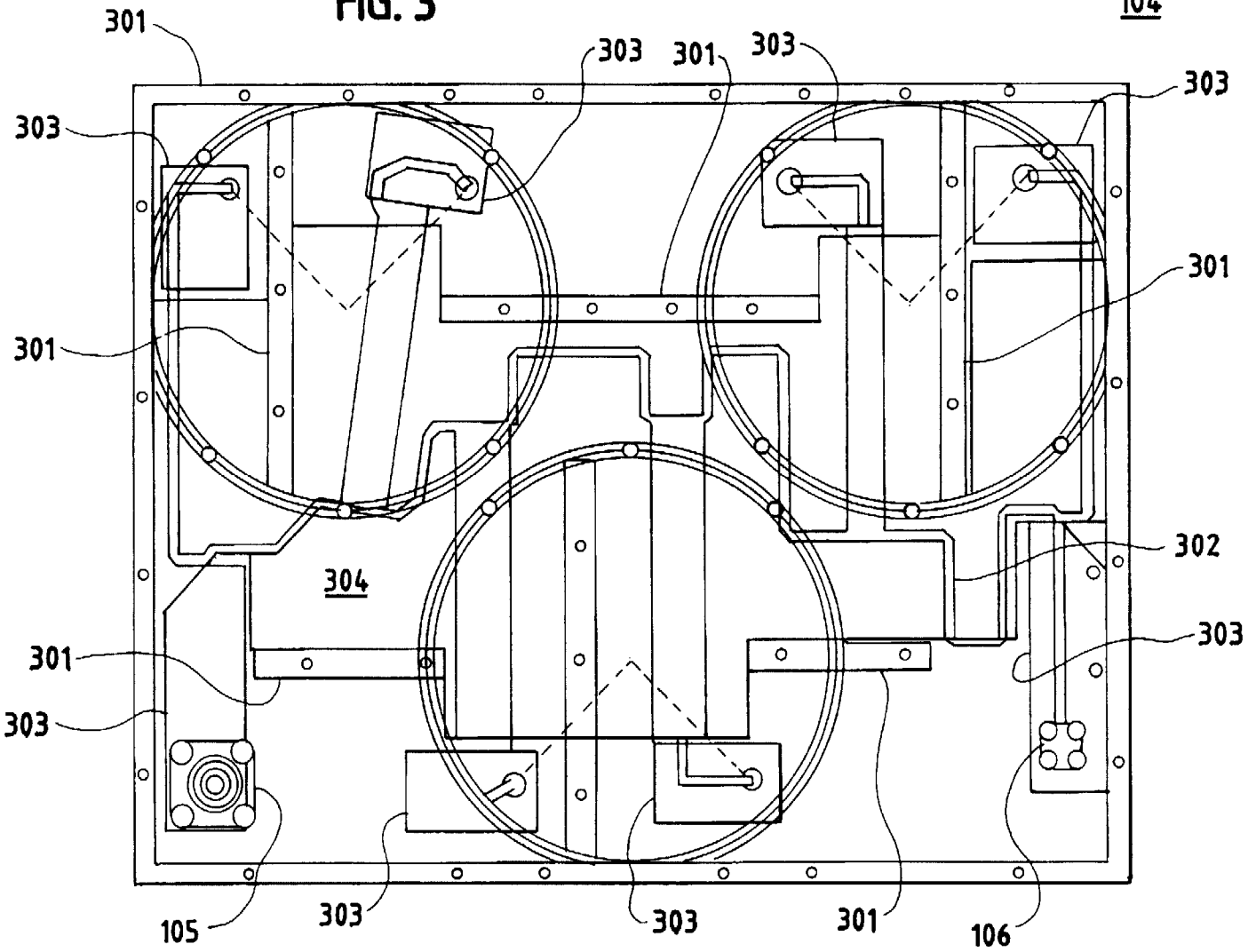
FIG. 3 is a top view of the stripline assembly of the filter of FIG. 1.

The stripline assembly 104 (FIG. 1), detailed (and drawn approximately to scale) in FIG. 3, is comprised of conductive top and bottom ground planes 129–130, spaced apart by conductive supports 301, upper and lower TEFLON band dielectric mate supports 303, upper and lower polystyrene foam supports 304, a center conductor 302, coupling probes 112, 114 soldered to the center conductor and supported with Rexolite **112*a*, 114*a*, a 50 ohm female N-type connector 105 whose center pin is soldered to center conductor 302, and a 50 ohm female SMA connector 106 whose center pin is soldered to center conductor 302**.

Figure 4:
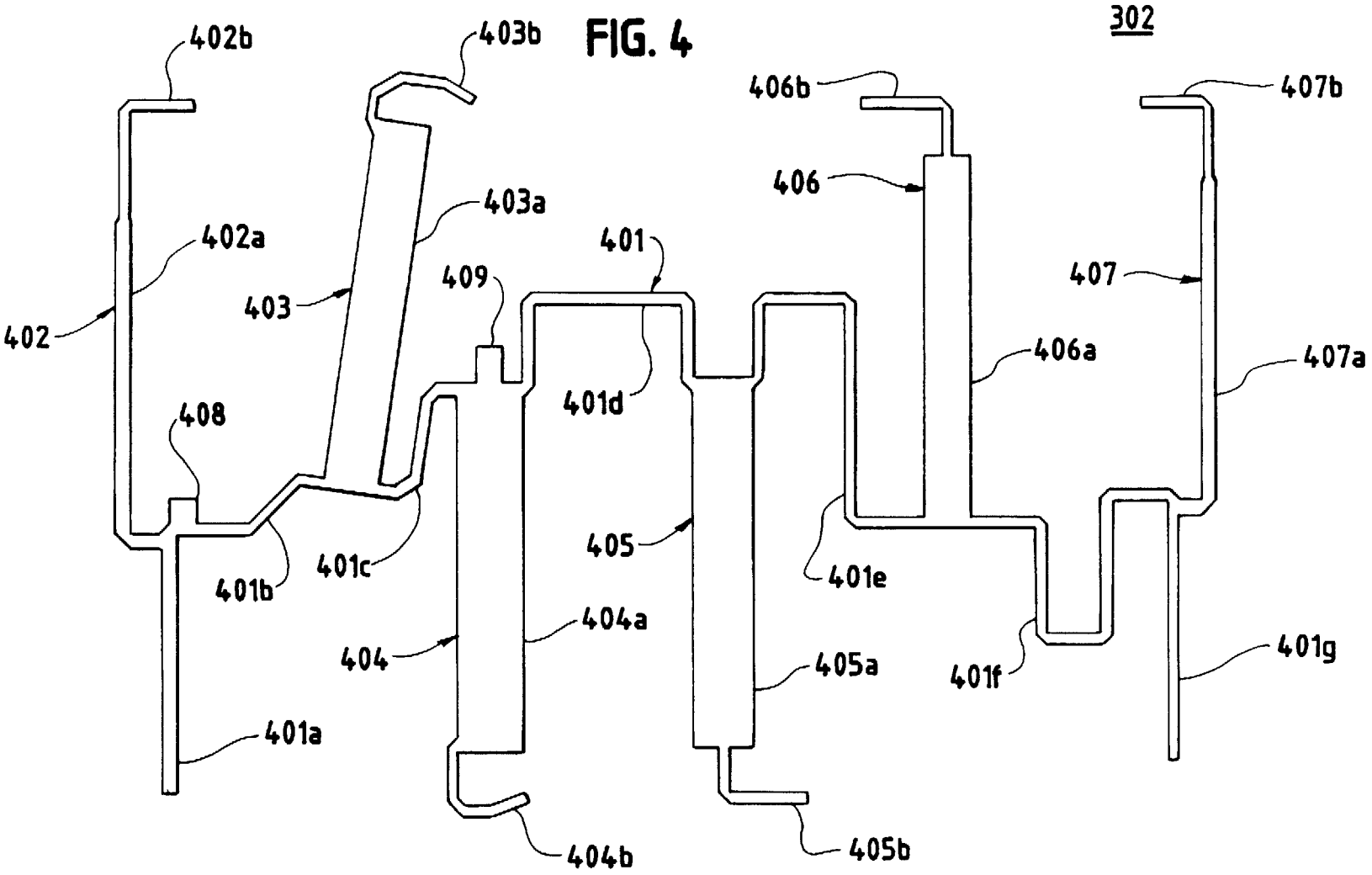
FIG. 4 is a top view of the layout of the stripline center conductor depicted in FIG. 3.

The stripline center conductor 302, detailed (and drawn approximately to scale) in FIG. 4, is comprised of a single main (through) planar transmission line 401, with seven sections **401*a*–401*g* of varying, but overall relatively high impedances (relatively narrow widths), and six open circuited "stub" transmission lines 402–407. These six stubs are each composed of a first relatively low impedance section 402*a*–407*a* which is approximately a quarter wavelength long at the center frequency $f_c$ of the stop band, and of a second relatively high impedance section 402*b*–407*b* which is less than a quarter wavelength long at $f_c$. The dual-mode resonator coupling probes 112, 114 are soldered to the open ends of these stub sections. In order to optimize the return loss of the passbands of the filter response, compensation stubs 408 and 409 were added to the center conductor (their size and position being experimentally determined). Any substantial change in the layout of the center conductor 302 or in the coupling probes, or their surrounding environment, could require a change in the number, size, and location of compensation stubs such as 408 and 409** for optimum filter performance.

Each of the substantially identical resonators 101–103 (FIG. 1) is housed in a conductive, circular-cylindrically shaped cavity 119–121. Each cavity 119–121 is preferably a 4.625" ID (inside diameter), 5.000" OD (outside diameter), 4.500" tall, silver-plated aluminum cylinder with a 0.062" thick, silver-plated aluminum, circular top lid. Of course, it is possible to use other construction methods and other materials (as long as the inner surface portions are formed from a high-conductivity material, such as silver or copper) for the cavities.

Each resonator includes a circular-cylindrically shaped ceramic element 122, as can be appreciated from an inspection of the interior of the second resonator 102 as illustrated in FIG. 2. A suitable ceramic material for the high dielectric constant, ceramic element 122 is a low-loss (low dielectric loss tangent) Barium Titanate ($BaO/TiO_2$) ceramic, with a dielectric constant of approximately 34 and a temperature coefficient of frequency, $\tau_f$, of approximately zero, although ceramics with other properties could be used as well. The ceramic element 122 is preferably circular-cylindrical in shape, with a 2.818" OD, an axial 0.200" ID opening therethrough (131 in FIG. 1), and a 2.720" length. The OD's are generally ground uniformly to adjust the frequency of the resonances so that they are just a few megahertz higher than the desired resonant frequencies.

It is common practice to specify a solid ceramic, without any central axial hole, for $HEH_{11}$ dual-mode applications, because any axial hole would be expected to degrade the unloaded Q of the resonant modes. However, upon experimentation, it was discovered that a relatively small diameter axial hole 131 (less than 10% of the outer diameter of the ceramic element 122) does not excessively degrade the unloaded Q of the $HEH_{11}$ dual-mode. The axial opening 131 provides a convenient means for mechanically attaching to the ceramic element 122, while significantly improving the yield (and consequently the cost), and mechanical reliability, of the ceramic element 122. Using this configuration of ceramic element 122, unloaded Q's of complete resonator assemblies with several different ceramic support configurations and cavity materials ranged from 30,000 to 40,000. This is as much as 10,000 higher than comparable $TE_{01}$ single-mode resonators of the prior art.

Since the resonator implementation utilizes $HEH_{11}$ dual resonant modes, the ceramic element 122 must be supported within the cavity 120 so as not to make direct physical contact with the conductive cavity walls. Although several configurations of support materials—such as shaped polystyrene foam pieces, Rexolite support rods, and/or quartz (glass) support rods—were used in various implementations, the preferred embodiment uses two 0.250" diameter support rods 123–124 made of GE Plastic's machinable ULTEM 2400, a glass-reinforced thermoplastic polyetherimide.

One rod 123 spaces the ceramic element 122 approximately 0.890" from the top of the stripline top ground plane 129, while the other support rod 124 spaces the ceramic element 122 approximately 0.890" from the top of the cavity 120, so that the ceramic element 122 is approximately centered in the 4.500" inside height of the cavity 120, and such that the ceramic element 122 is supported in firm compression within the cavity 120.

A step in the diameter of one end of each support rod 123, 124 preferably allows this portion of the rods to be fit into the 0.200" diameter axial opening 131 through the ceramic element 122, so that the rods 123, 124 can be glued to the ceramic element 122. A drilled and tapped hole, or holes, in the other end of the rods 123, 124 preferably allows them to be firmly attached with screws to the base and top of the cavity 120. Consequently, the whole resonator assembly is fixed and rigid, resulting in a dual-mode dielectrically loaded cavity resonator which is essentially impervious to thermal and mechanical shock and vibration, yet is very simple to assemble and requires a minimal amount of lossy support material.

A temperature compensating element 125–126 may be included for each resonant mode. As is true in a variety of other types of microwave filters, the use of bi-metal temperature compensation elements, and/or a properly chosen set of materials (with material and electrical properties which are either stable or compensating with respect to temperature) to construct the resonators from, generally results in adequate temperature stability for dual-mode resonators and filters. In the bandstop filter implementation of the present invention, bi-metal temperature compensation elements 125, 126 have been used to compensate the temperature coefficient of frequency of the resonances coupled to by probes 112, 114, respectively. Each temperature compensating element 125, 126 preferably comprises a 0.188" diameter, 0.440" long, cylindrical, silver-plated, copper post attached on its top end to the top plate of the cavity 120 at a radius of 2.203" from the center of the top plate. A 0.88" long, 0.55" wide, 0.015" thick, temperature sensitive bi-metal strip comprised of material HR30 manufactured by Hood is preferably soldered into a 0.018" tall slot cut halfway into the side of, and centered 0.049" from the bottom of, the copper post.

The coupling probes 112, 114 are supported on pedestals **112*a*, 114*a* of Rexolite. Each coupling probe 112, 114 is preferably located at a radius of 1.934" from the central axis of the cavity 120 and is preferably formed from a 0.064" diameter bare copper wire soldered to and in line with the central axis of a 0.375" diameter, 0.575" long, silver-plated, INVAR rod. The other end of the copper wire is soldered to an open end of a stripline center conductor stub 404*b*, 405*b* (FIG. 4). The copper wire is preferably mechanically supported with a surrounding 0.250" diameter Rexolite tube 112*a*, 114*a*. The Rexolite tube 112*a*, 114*a* also helps to accurately and repeatably locate the height of the probe 112, 114 above the base of the cavity 120**.

Each coupling probe 112, 114 preferably has, in its larger diameter portion, a silver-plated 6-32 set screw **112*b*, 114*b*, perpendicular to and intersecting with the axis of the probe 112, 114, and oriented along plane 201 or 202, as appropriate. These set screws 112*b*, 114*b* are accessed through holes in the cavity 120 provide fine adjustments of the degree of coupling of the probes 112, 114**.

The interior layouts of the separate resonators 101–103 are substantially identical. Thus, within the exemplary second resonator 102, the coupling probe 112, the frequency tuning screw 111 (FIG. 2), and the temperature compensating element 125 are all oriented in approximately the same first vertical plane 201 through the central axis of the ceramic element 122, and are all associated with the first resonance $f_3$ of the resonator 102. Coupling probe 114, frequency tuning screw 113, and temperature compensating element 126 are all oriented in approximately the same second vertical plane 202 through the central axis of the ceramic element 122—which is orthogonal to the first such vertical plane 201—and are all associated with the second resonance $f_4$, orthogonal to the first resonance. Mode decoupling screws 127 and 128 have main axes which are orthogonal to each other and which are oriented an odd multiple of 45 degrees from frequency tuning screws 111 and 113.

The design of the bandstop filter 100 calls for the absence of direct coupling between resonances to function as intended. However, the orthogonal resonances of a dual-mode resonator cannot be physically isolated. In addition, asymmetries, irregularities, and other non-idealities in the shapes, positions, or compositions of the materials comprising a dual-mode dielectric resonator introduce coupling between its two orthogonal resonances. Thus, a way must be provided to compensate for, or cancel, this unwanted coupling between the two orthogonal resonances of a dual-mode dielectric resonator which unavoidably occurs in practice.

In dual-mode bandpass filters it is common practice to use a single mode coupling screw, oriented 45 degrees from either of the orthogonal resonant mode axes, to create and adjust coupling between the mode resonances. If one considers how such a mode coupling screw actually creates coupling between orthogonal modes, one can conclude that the asymmetry introduced into an otherwise symmetrical dual-mode resonator cavity by the screw is responsible for causing the coupling. Hence, if one introduced an identical asymmetry orthogonal to the first asymmetry and in the same plane orthogonal to the axis of symmetry of the resonator, then symmetry should be restored to the cavity and the mode coupling should be reduced to zero. That is, the two asymmetries effectively cancel each other out.

Now, assume that coupling exists between the two orthogonal modes in a dual-mode cavity, but that the origin of the asymmetry responsible for this mode coupling is unknown, so that cancelling this coupling by duplicating the asymmetry in an orthogonal manner is not possible. However, if two screws are introduced to the resonator and oriented orthogonally to each other about the central axis of the resonator (and are not perfectly aligned with the orthogonal resonant modes themselves), then, as one of these screws is inserted into the resonator cavity, the existing coupling should increase, while, as the other of the screws is inserted into the resonator cavity, the existing coupling should decrease.

At some point, if the screw which causes the decrease in mode coupling is large enough and penetrates the cavity deep enough, and has a large enough effect, the coupling between the orthogonal modes can be eliminated. While only a single screw is needed to cancel a dual-mode coupling of unknown origin, it is preferable to have two orthogonal screws available, since it is unknown beforehand which one of the two will actually function to decouple the modes. It is clear that such an approach can function for the purpose of mode decoupling in a dual-mode bandstop filter, and, consequently, mode decoupling screws have been introduced into each of the dual-mode dielectric resonators of the bandstop filter 100. Since all of the resonators are substantially identical, only mode decoupling screws 127 and 128 will be considered here for the sake of brevity.

Although any angle between the mode decoupling screws 127 and 128 greater than 45 degrees and less than 135 degrees should be sufficient, they are most effective when oriented at 90 degrees to each other, so that the effect on the mode coupling of one of the screws is as nearly as possible the complement of the effect on the mode coupling of the other screw.

Also, although it is not necessary, it is preferable to orient the decoupling screws at an odd multiple of 45 degrees from the planes of the two orthogonal resonances (i.e., from planes defined by the axis of each coupling probe with the axis of the resonator) so that the decoupling screws 127, 128 have the same effect on the frequency of one of the dual resonances as they have on the other. This preferred orientation of the decoupling screws 127, 128 with respect to the coupling probes 112, 114, the resonance planes 201, 202, and to each other is shown in FIG. 2.

The stripline transmission line assembly 104, depicted in FIG. 3, is comprised of conductive top and bottom ground planes 129–130 spaced apart by conductive supports 301. A central conductive portion 302, which may be termed a microwave circuit, is disposed in the form of interconnected transmission lines of various widths. The coupling probes for the resonators, such as coupling probes 112 and 114 for the second resonator 102, are soldered to this central conductive portion 302, as are the center pins of the connectors 105–106.

The combination of the low impedance section and its associated high impedance section acts as an impedance transformer. For example, transmission line section 404, comprising low impedance section **404*a* and high impedance section 404*b*, acts as an impedance transformer shunt coupled to the main transmission line 401, and coupled to the resonator 102 only through a coupling means, which, in this case, is the coupling probe 112**.

The stripline transmission line assembly 104 is preferably formed from a 0.003" thick "full hard," bare copper conductive portion 302, machined or etched to match the shape of the reduced size outline illustrated in FIG. 4. The 0.100" wide open-ended stub sections **403*b*–407*b* of the central conductive portion 302 are preferably spaced apart from the 0.0625" thick silver-plated aluminum top 129 and bottom 130 ground planes by 0.125" thick TEFLON brand dielectric mate pieces 303** above and below.

The original stripline center conductor 302 design dimensions, shown in Table 1, were experimentally modified to compensate for non-idealities introduced by the attached probes, the Rexolite probe supports, and the bends, miters, T-junctions, and abrupt changes in width in the actual center conductor layout. Correction of the filter performance was achieved by slightly altering the design widths of center conductor line sections **401*a*, 401*c*, 401*d*, 401*f*, and 401*g*, and by adding the small stubs 408 and 409 to the center conductor 401**. The dimensional details of the stripline design and compensation would be expected to be different for different filter requirements and designs.

The final center conductor 302 modified line section dimensions are shown in Table 2. Note that, in Table 1 and Table 2, the lengths of the line sections **401*a*–401*g* and 402*a*–407*a*, are measured up to, but not including, the rectangular area of their respective intersections, and the lengths of compensation line sections 408 and 409 are measured up to, but not including, their intersections with the main through transmission line 401**.

TABLE 1

| Line Section | Width (inches) | Length (inches) | Impedance (ohms) | Elec. Length at $f_c$ (deg.) | Dielectric |
|---|---|---|---|---|---|
| 401a | 0.100 | 2.408 | 75.23 | 90.00 | TEFLON brand dielectric material |
| 401b | 0.100 | 1.726 | 109.03 | 44.52 | polystyrene foam |
| 401c | 0.100 | 1.495 | 109.03 | 38.57 | polystyrene foam |
| 401d | 0.100 | 3.126 | 109.03 | 80.65 | polystyrene foam |
| 401e | 0.100 | 4.411 | 109.03 | 113.78 | polystyrene foam |
| 401f | 0.100 | 4.649 | 109.03 | 119.92 | polystyrene foam |
| 401g | 0.100 | 2.408 | 75.23 | 90.00 | TEFLON brand dielectric material |
| 402a | 0.131 | 3.489 | 94.75 | 90.00 | polystyrene foam |
| 402b | 0.100 | 1.794 | 75.23 | 67.06 | TEFLON brand dielectric material |
| 403a | 0.539 | 3.489 | 35.42 | 90.00 | polystyrene foam |

TABLE 1-continued

| Line Section | Width (inches) | Length (inches) | Impedance (ohms) | Elec. Length at $f_c$ (deg.) | Dielectric |
|---|---|---|---|---|---|
| 403b | 0.100 | 1.370 | 75.23 | 51.22 | TEFLON brand dielectric material |
| 404a | 0.643 | 3.489 | 30.58 | 90.00 | polystyrene foam |
| 404b | 0.100 | 1.377 | 75.23 | 51.49 | TEFLON brand dielectric material |
| 405a | 0.597 | 3.489 | 32.55 | 90.00 | polystyrene foam |
| 405b | 0.100 | 1.298 | 75.23 | 48.52 | TEFLON brand dielectric material |
| 406a | 0.452 | 3.489 | 40.86 | 90.00 | polystyrene foam |
| 406b | 0.100 | 1.369 | 75.23 | 51.19 | TEFLON brand dielectric material |
| 407a | 0.141 | 3.489 | 90.92 | 90.00 | polystyrene foam |
| 407b | 0.100 | 1.408 | 75.23 | 52.62 | TEFLON brand dielectric material |

TABLE 2

| Line Section | Width (inches) | Length (inches) |
|---|---|---|
| 401a | 0.140 | 2.408 |
| 401c | 0.119 | 1.495 |
| 401d | 0.116 | 3.126 |
| 401f | 0.106 | 4.649 |
| 401g | 0.090 | 2.408 |
| 408 | 0.250 | 0.250 |
| 409 | 0.250 | 0.315 |

The dual-mode resonator coupling probes 112 and 114 are soldered to the open ends of stub sections 404 and 405. The other two resonators 101 and 103 have their coupling probes soldered to stub sections in substantially the same manner.

Figure 5:
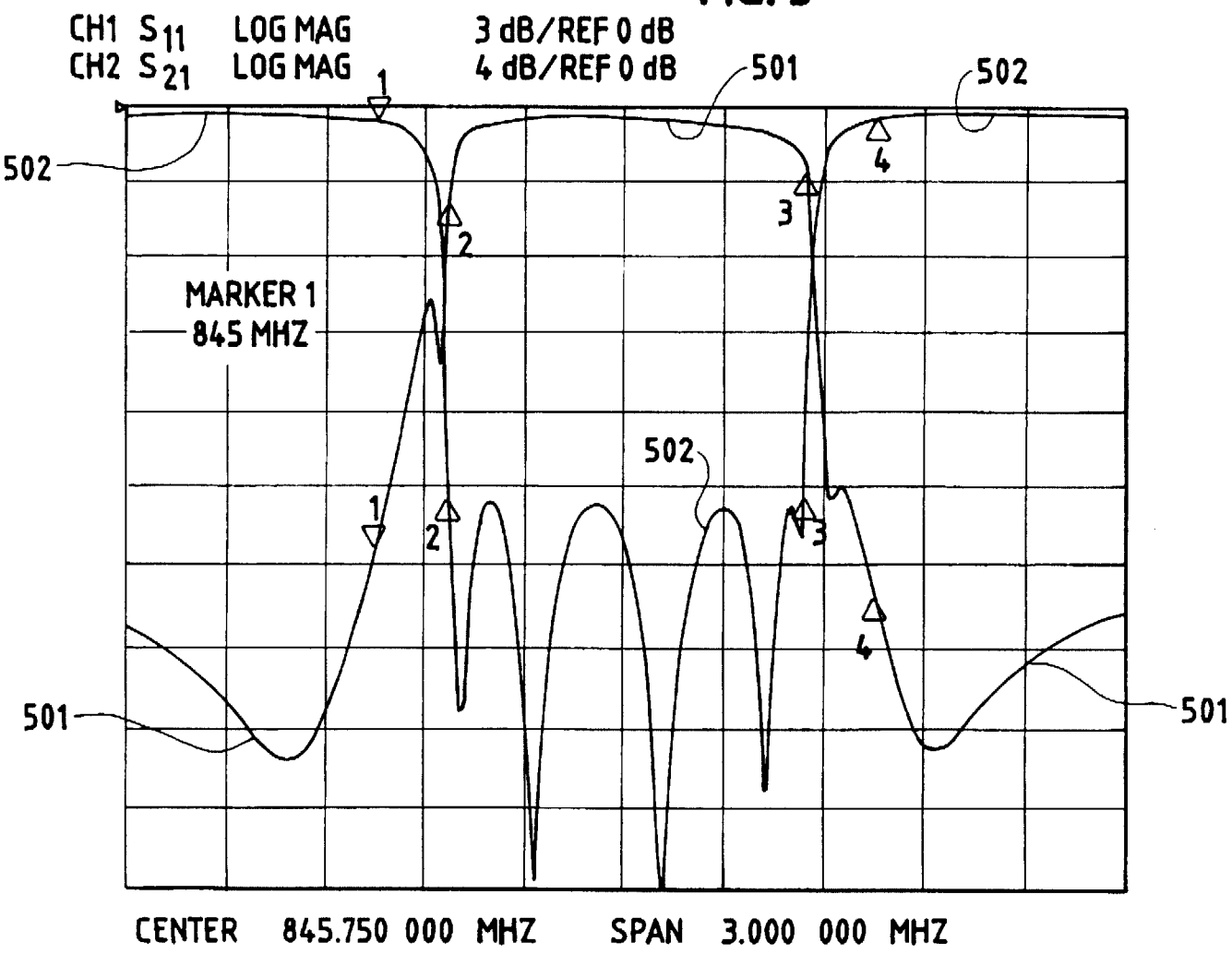
FIG. 5 illustrates representative performance characteristics of the filter of FIG. 1.

FIG. 5 is a plot of the measured filter performance of the dual-mode dielectric resonator bandstop filter 100 over the frequency range of 844.25 MHz to 847.25 MHz with $f_c$=845.75 MHz. The filter return gain ($S_{11}$) 501 is indicated by Channel 1 (CH1) in the plot with a vertical scale of 3 dB/division and a horizontal scale of 300 KHz/division. The filter transmission gain ($S_{21}$) 502 is indicated by Channel 2 (CH2) in the plot with a vertical scale of 4 dB/division and a horizontal scale of 300 KHz/division. Markers 1, 2, 3, and 4 are located at 845 MHz, 845.22 MHz, 846.28 MHz, and 846.5 MHz, respectively. It is evident from the plot of FIG. 5 that the filter stop band attenuation is greater than 20 dB, the filter passband insertion loss is less than 1 dB, and the filter passband return loss is greater than 14 dB.

In the preferred embodiment, the frequencies of the individual resonances for the filter 100 were designed to be

| Resonator 101 | Resonator 102 | Resonator 103 |
|---|---|---|
| $f_1$ = 845.18 MHz | $f_3$ = 845.47 MHz | $f_5$ = 846.19 MHz |
| $f_2$ = 845.24 MHz | $f_4$ = 845.93 MHz | $f_6$ = 846.28 MHz |

However, because of the nature of $HEH_{11}$ dual-mode dielectric resonators, adequate detuning of one resonance has too great an effect on the frequency of the orthogonal resonance in the same resonator, and has a significant effect on the coupling between the two orthogonal resonances, so that it is impractical to have a tuning method that allows one to look at just one of the two resonances of each resonator. Consequently, coarse tuning of the filter 100 is accomplished by tuning the coupling to, the coupling between, and the frequency of the two orthogonal resonances of each dual-mode resonator as a pair, with the resonances of the other resonators detuned. Detuning of resonances is accomplished with dedicated detuning screws not shown in the figures and not part of the final filter 100. Each of the three resonance pairs are tuned so that the filter performance, with just that pair of resonances, approximately matches the simulated response of the desired filter under the same conditions of having the other two pairs of resonances detuned.

For the second resonator 102, for example, the degree of coupling of probes 112 and 114 is tuned using set screws **112*b* and 114*b*, the coupling between the orthogonal resonances is minimized using the mode decoupling screws 127 and 128, and the frequency of the first resonance is tuned with frequency adjustment screw 111 while the frequency of the other orthogonal resonance is tuned with frequency adjustment screw 113. Fine tuning of the filter 100** is accomplished by iteratively making small adjustments to the frequency tuning screws and the mode decoupling screws of each of the resonators in turn.

There has been described herein a dual-mode dielectric resonator bandstop filter incorporating multiple impedance transformations that is relatively free from the shortcomings of the prior art. It will be apparent to those skilled in the art that modifications may be made without departing from the spirit and scope of the invention. Accordingly, it is not intended that the invention be limited except as may be necessary in view of the appended claims.

What is claimed is:

1. An electromagnetic bandstop filter comprising:

a microwave circuit;

at least one microwave resonator;

coupling means that couples electromagnetic energy to and from said microwave resonator; and an impedance transformer coupled to, and in series with, said coupling means, wherein said transformer is coupled to said resonator only through said coupling means, and wherein said impedance transformer is shunt coupled to said microwave circuit.

2. The filter of claim 1, wherein said coupling means is a coupling probe having two ends, with one of said ends open-circuited, and the other of said ends coupled to said impedance transformer.

3. The filter of claim 2, wherein said resonator is a dual-mode dielectric resonator, and said probe is coupled to a resonance of said dual-mode dielectric resonator.

4. The filter of claim 1, wherein said impedance transformer comprises at least two series-connected transmission line sections of different impedances.

5. The filter of claim 4, wherein said impedance transformer has an operating frequency corresponding to an operating wavelength, and said impedance transformer is comprised of a first transmission line having at least two sections of different impedance, a first section of said first transmission line having a length of an odd multiple of a quarter of said wavelength and having a first impedance, and a second section of said first transmission line having a second impedance larger than said first impedance, and wherein one end of said second section is coupled to one end of said first section, and wherein the other end of said second section is coupled to said coupling means.

6. The filter of claim 5, wherein said microwave circuit comprises a second transmission line, said second transmission line having a third impedance larger than said first impedance.

7. The filter of claim 6, wherein said first and second transmission lines are planar transmission lines comprising at least two conductors and at least one dielectric at least partially separating two of said conductors.

8. The filter of claim 7, wherein said planar transmission lines are striplines.

9. The filter of claim 1, wherein said microwave circuit comprises a common transmission line of a microwave bandstop filter, said common transmission line has an input end and an output end, and said input and output ends function as signal input and output, respectively, of said filter.

10. A bandstop filter comprising:

a first transmission line with an input end and an output end;

at least one resonator; and at least one coupling means for coupling electromagnetic energy between said first transmission and a resonance of said resonator;

said coupling means having a coupling element and an impedance transformer attached to said coupling element;

wherein said impedance transformer is coupled to said resonance only through said coupling element, and said impedance transformer is coupled directly to said first transmission line.

11. The bandstop filter of claim 10, wherein said coupling element comprises a coupling probe.

12. The bandstop filter of claim 10, wherein said impedance transformer has an operating frequency corresponding to an operating wavelength, and said impedance transformer is comprised of a second transmission line having at least two sections of different impedance, a first section of said second transmission line having a length of an odd multiple of a quarter of said wavelength and having a first impedance, and a second section of said second transmission line having a second impedance larger than said first impedance, and wherein one end of said second section is coupled to one end of said first section, and wherein the other end of said second section is coupled to said coupling means.

13. The filter of claim 12, wherein said first transmission line has a third impedance larger than said first impedance.

14. A microwave bandstop filter with a predetermined stop band having a center frequency corresponding to an operating wavelength, the filter comprising:

a first transmission line with an input end and an output end;

at least one microwave dual-mode resonator having a first resonance and a second resonance within said stop band;

a first coupling means for coupling microwave energy between said transmission line and said first resonance;

a second coupling means for coupling microwave energy between said transmission line and said second resonance;

said first and second coupling means each comprising a coupling mechanism coupled to said resonance and attached to a first impedance transformer that is coupled to said resonance only through said coupling mechanism; and wherein said impedance transformer is coupled directly to said first transmission line.

15. The filter of claim 14, wherein said dual-mode resonator is a dual-mode dielectric resonator.

16. The filter of claim 15, wherein said coupling mechanism is a coupling probe having two ends, with one of said ends open circuited, and the other of said ends attached to said first impedance transformer.

17. The filter of claim 16, wherein said first impedance transformer has an operating frequency corresponding to said center frequency and said operating wavelength, said first impedance transformer comprises a second transmission line having at least two sections of different impedance, a first section of said second transmission line having a length of an odd multiple of one-quarter of said operating wavelength and having a first impedance, and a second section of said second transmission line having a second impedance larger than said first impedance, and wherein one end of said second section is coupled to one end of said first section, and wherein the other end of said second section is coupled to said coupling probe.

18. The filter of claim 17, wherein said first transmission line has a third impedance larger than said first impedance.

19. The filter of claim 17, wherein said first and second transmission lines are planar transmission lines, comprising at least two conductors and at least one dielectric at least partially separating two of said conductors.

20. The filter of claim 19, wherein said planar transmission lines are striplines.

21. The filter of claim 14, wherein said first transmission line incorporates a second impedance transformer in series with said input end and a third impedance transformer in series with said output end.

22. A microwave bandstop filter having a stop band with a predetermined center frequency, the filter comprising:

a microwave transmission line with an input end and an output end;

at least one microwave dual-mode resonator having a first resonance along a first axis and a second resonance along a second axis orthogonal to said first axis, wherein both of said resonances are within said stop band;

a first coupling means for coupling microwave energy between said transmission line and said first resonance;

a second coupling means for coupling microwave energy between said transmission line and said second resonance; and a mode decoupling means for substantially reducing coupling between said resonances.

23. The microwave bandstop filter of claim 22, wherein said mode decoupling means comprises at least one of two orthogonal screws located at an odd multiple of 45 degrees with respect to said axes.

24. The microwave bandstop filter of claim 22, further comprising:

first resonant mode frequency tuning means oriented in a common first vertical plane with said first coupling means; and second resonant mode frequency tuning means oriented in a common second vertical plane with said second coupling means, said second vertical plane orthogonal to said first vertical plane.

25. The microwave bandstop filter of claim 24, wherein said mode decoupling means comprises at least one of two mode decoupling screws having mutually orthogonal main axes, wherein each of said main axes is oriented an odd multiple of 45 degrees with respect to both said first and second vertical planes.

26. A microwave filter having a transmission line with an input end and an output end, and at least one tunable dual-mode resonator, the filter comprising:

a conductive cavity, having at least a first planar surface;

a first tuning means for tuning said resonator to a first resonance at a first frequency along a first axis;

a second tuning means for tuning said resonator to a second resonance at a second frequency along a second axis orthogonal to said first axis;

a first coupling means for coupling microwave energy between said transmission line and said first resonance;

a second coupling means for coupling microwave energy between said transmission line and said second resonance;

said first and second coupling means each comprising a coupling mechanism coupled to said resonance and attached to a first impedance transformer that is coupled to said resonance only through said coupling mechanism;

wherein said first and second coupling means enter said resonator cavity through said first planar surface; and wherein said first impedance transformer is coupled directly to said transmission line.

27. The filter of claim 26, wherein said dual-mode resonator is a dual-mode dielectric resonator.

28. The filter of claim 27, wherein said dual-mode dielectric resonator is an HEH11 dual-mode dielectric resonator, said cavity includes a ceramic component, and said cavity and said ceramic component are circular-cylindrical in shape and share a common central axis.

29. The filter of claim 28, wherein said dual-mode resonator includes mode decoupling means for substantially reducing coupling between said resonances.

30. The filter of claim 29, wherein said mode decoupling means comprises at least one of two orthogonal screws, oriented radially with respect to said central axis, and located at an odd multiple of 45 degrees with respect to said resonance axes.

31. The filter of claim 28, wherein said ceramic component of said dual-mode dielectric resonator is circular-cylindrical in shape with an associated outer diameter, and includes an opening along its axis, wherein said opening is no smaller in diameter than two percent of said outer diameter of said ceramic component, and no larger in diameter than 10 percent of said outer diameter of said ceramic component through which it extends.

32. The filter of claim 26, wherein at least some of said resonances are tuned to different frequencies.

33. The filter of claim 32, wherein said resonances are coupled to said transmission line in a predetermined sequence, and are tuned in ascending order according to said sequence.

34. The filter of claim 26, wherein said transmission line incorporates a second impedance transformer in series with said input end and a third impedance transformer in series with said output end.

35. A filter including at least one dual-mode dielectric resonator, wherein said resonator comprises:

a conductive cavity;

a ceramic component within said cavity, wherein said ceramic component is circular-cylindrical in shape with an associated outer diameter and includes an opening along its central axis, wherein said opening is no smaller in diameter than two percent of said outer diameter of said ceramic component, and no larger than 10 percent of said outer diameter of said ceramic component through which it extends;

upper and lower support means, wherein a portion of said support means engages said opening in said ceramic and said support means maintains said ceramic from making direct contact with said cavity;

a first resonance at a first frequency along a first axis;

a second resonance at a second frequency along a second axis orthogonal to said first axis;

a first coupling means for coupling microwave energy between an external circuit and said first resonance;

a second coupling means for coupling microwave energy between an external circuit and said second resonance; and means for adjustably decoupling said resonances.

36. A filter including at least one dual-mode resonator, wherein said dual-mode resonator comprises:

a conductive cavity, having at least a first planar surface;

a first resonance, within said cavity, at a first frequency along a first axis;

a second resonance, within said cavity, at a second frequency along a second axis orthogonal to said first axis;

a first coupling means for coupling microwave energy between an external circuit and said first resonance;

a second coupling means for coupling microwave energy between an external circuit and said second resonance;

wherein said first and second coupling means enter said resonator cavity through said first planar surface.

37. The filter of claim 36, wherein, within said cavity, said first and second coupling means are substantially perpendicular to said first planar surface.

38. The filter of claim 36, wherein said dual-mode resonator is a dual-mode dielectric resonator.

39. The filter of claim 36, further comprising adjustable decoupling means for reducing the coupling between said resonances.

40. The filter of claim 39, wherein said adjustable decoupling means are mode decoupling means comprising at least one of two orthogonal screws located at an odd multiple of 45 degrees with respect to said axes.

41. The filter of claim 40, wherein said orthogonal screws are oriented radially with respect to a central axis of said resonator.

42. The filter of claim 36, wherein a first planar transmission line is coupled to said first resonator coupling means, and a second planar transmission line is coupled to said second resonator coupling means.

43. The filter of claim 42, wherein said first planar transmission line is coupled to a first location along a third planar transmission line, and said second planar transmission line is coupled to a second location along said third planar transmission line.

* * * * *

UNITED STATES PATENT AND TRADEMARK OFFICE

CERTIFICATE OF CORRECTION

PATENT NO. : 5,798,676

DATED : August 25, 1998

INVENTOR(S) : Douglas R. Jachowski

It is certified that error appears in the above-indentified patent and that said Letters Patent is hereby corrected as shown below:

Column 8, line 36, delete "band" and insert --brand--.

Column 15, line 16, delete "transmission" and insert --line--.

Signed and Sealed this

Ninth Day of March, 1999

*Attest:*

*Attesting Officer*

Q. TODD DICKINSON

*Acting Commissioner of Patents and Trademarks*

UNITED STATES PATENT AND TRADEMARK OFFICE

CERTIFICATE OF CORRECTION

PATENT NO. : 5,798,676
DATED : August 25, 1998
INVENTOR(S) : Douglas R. Jachowski It is certified that error appears in the above-indentified patent and that said Letters Patent is hereby corrected as shown below:

Column 7, line 38, delete "$HEH_1L$" and insert --$HEH_{11}$--.

Column 7, line 50, delete "$HEH_1L$" and insert --$HEH_{11}$--.

Signed and Sealed this

Fifteenth Day of June, 1999

*Attest:*

Q. TODD DICKINSON

*Attesting Officer*

*Acting Commissioner of Patents and Trademarks*